US010197220B2

(12) United States Patent
Faka

(10) Patent No.: US 10,197,220 B2
(45) Date of Patent: Feb. 5, 2019

(54) INTEGRATED STORAGE/OFFLOADING FACILITY FOR AN LNG PRODUCTION PLANT

(71) Applicant: Woodside Energy Technologies Pty Ltd., Perth (AU)

(72) Inventor: Solomon Aladja Faka, Perth (AU)

(73) Assignee: Woodside Energy Technologies Pty Ltd, Perth (AU)

( * ) Notice: Subject to any disclaimer, the term of this patent is extended or adjusted under 35 U.S.C. 154(b) by 875 days.

(21) Appl. No.: 14/640,645

(22) Filed: Mar. 6, 2015

(65) Prior Publication Data

US 2015/0176765 A1 Jun. 25, 2015

Related U.S. Application Data

(63) Continuation of application No. PCT/AU2013/000258, filed on Mar. 15, 2013.

(30) Foreign Application Priority Data

Sep. 21, 2012 (AU) ..... 2012904129

(51) Int. Cl.

| | |
|---|---|
| ***F17C 5/02*** | (2006.01) |
| ***F17C 3/00*** | (2006.01) |
| ***F25J 1/00*** | (2006.01) |
| ***B63B 25/16*** | (2006.01) |
| ***B63B 25/08*** | (2006.01) |
| ***B63B 27/24*** | (2006.01) |
| ***F25J 1/02*** | (2006.01) |

(Continued)

(52) U.S. Cl.

CPC ..... *F17C 5/02* (2013.01); *B63B 27/24* (2013.01); *F17C 1/002* (2013.01); *F17C 3/025* (2013.01);

(Continued)

(58) Field of Classification Search

CPC ..... F17D 1/082; F17C 1/002; F17C 3/005; F17C 3/025; F17C 13/004;

(Continued)

(56) References Cited

U.S. PATENT DOCUMENTS 2,584,867 A * 2/1952 Guarin ..... E02B 3/062 405/23
3,735,600 A * 5/1973 Dowdell ..... F25J 1/0282 62/619

(Continued)

FOREIGN PATENT DOCUMENTS

AU 2012207058 A1 8/2012
FR 2967484 A1 5/2012

(Continued)

OTHER PUBLICATIONS

International Search Report in counterpart International Application No. PCT/AU2013/000258, dated Jun. 19, 2013.

(Continued)

*Primary Examiner* — Frantz Jules

*Assistant Examiner* — Erik Mendoza-Wilkenfe

(74) *Attorney, Agent, or Firm* — Edell, Shapiro & Finnan, LLC

(57) ABSTRACT

An LNG production plant positioned at a production location adjacent to a body of water is described. The LNG production plant includes a plurality of spaced-apart facilities including a first facility and a second facility, each facility provided with plant equipment related to a predetermined function associated with the production of LNG, where the first facility is an onshore facility and the second facility is an integrated storage/offloading facility arranged on a gravity-based structure having a base that rests on the seabed at a selected location within the body of water.

27 Claims, 7 Drawing Sheets

(51) Int. Cl.
*F17C 3/02* (2006.01)
*F17C 1/00* (2006.01)

(52) U.S. Cl.
CPC ..... *F25J 1/0022* (2013.01); *F25J 1/0025* (2013.01); *F25J 1/0278* (2013.01); *B63B 25/16* (2013.01); *F17C 2201/052* (2013.01); *F17C 2203/0643* (2013.01); *F17C 2203/0648* (2013.01); *F17C 2205/0355* (2013.01); *F17C 2221/033* (2013.01); *F17C 2223/0161* (2013.01); *F17C 2270/0105* (2013.01); *F17C 2270/0113* (2013.01); *F17C 2270/0123* (2013.01); *F25J 2290/60* (2013.01)

(58) Field of Classification Search
CPC ..... F17C 2203/014; F17C 2203/037; F17C 2221/032; F17C 2221/033; F17C 2221/035; F17C 2221/036; B63G 8/001; B65D 88/78; B63B 25/08; B63B 27/24; F25J 1/0022
See application file for complete search history.

(56) References Cited

U.S. PATENT DOCUMENTS 4,202,648 A * 5/1980 Kvamsdal ..... B63B 35/44 114/256
4,365,576 A * 12/1982 Cook ..... B63B 35/44 114/257
2005/0115248 A1* 6/2005 Koehler ..... F17C 1/002 62/53.1
2008/0011357 A1 1/2008 Wille et al.
2008/0127654 A1* 6/2008 Darling ..... F17C 7/02 62/50.2
2008/0264076 A1* 10/2008 Price ..... F25J 1/0025 62/96
2011/0232767 A1* 9/2011 Liem ..... B63B 27/24 137/1
2012/0108117 A1* 5/2012 Kwon ..... B63B 25/14 440/6
2014/0053599 A1* 2/2014 Byfield ..... F28B 1/06 62/611

FOREIGN PATENT DOCUMENTS

WO 2006118458 A2 11/2006
WO 2007064209 A1 6/2007
WO 2007112498 A1 10/2007
WO WO 2011105712 A2 * 9/2011 ..... B63B 27/34

OTHER PUBLICATIONS

Search Report in counterpart European Application No. 13840097.3, dated Jul. 11, 2016.

* cited by examiner

INTEGRATED STORAGE/OFFLOADING FACILITY FOR AN LNG PRODUCTION PLANT

FIELD

The present invention relates to an integrated storage/offloading facility for a liquefied natural gas ("LNG") production plant.

BACKGROUND

Large volumes of natural gas (i.e., primarily methane) are located in remote areas of the world. This gas has significant value if it can be economically transported to market. Natural gas ("NG") is routinely transported from an onshore LNG production plant to another location in its liquid state as liquefied natural gas ("LNG") by way of loading the LNG in the cryogenic storage tanks of purpose built large ocean going vessels known as "LNG Carriers". Liquefaction of the natural gas makes it more economical to transport as LNG occupies only about 1/600th of the volume than the same amount of natural gas does in its gaseous state. Prior to liquefaction, raw natural gas that has been sourced from a wellhead is subjected to a series of gas pre-treatment processes including acid gas removal and dehydration to remove contaminants. After liquefaction, LNG is typically stored in cryogenic storage tanks at the LNG production plant either at or slightly above atmospheric pressure at a temperature of around −160 degrees Celsius.

Gas pre-treatment, liquefaction and storage are typically undertaken at a fixed onshore LNG production plant associated with a jetty that is built in sufficiently deepwater to allow berthing of the LNG Carriers. To ship liquefied natural gas (LNG) by sea, a way to transfer LNG between the cryogenic storage tanks of the onshore LNG production plant and the cryogenic storage tanks of the LNG Carrier is required. Traditionally, the transfer means has taken the form of an insulated pipe that is laid on an elevated supporting trestle structure between the onshore LNG production plant and the jetty so that the insulated pipe remains at all times above the water line. These prior art transfer facilities include a vapour return line to return boil-off gas to the onshore LNG production plant. After LNG have been loaded into the cryogenic storage tanks of the LNG Carrier vessel for marine transport LNG is regasified before distribution to end users through a pipeline or other distribution network at a temperature and pressure that meets the delivery requirements of the end users.

The cost of LNG storage and offloading facilities has continued to increase through the years and is now a very significant component of the total installed cost for an LNG project. Efforts to reduce this cost have largely been focused on storage tank size optimization and seeking to leverage the economics of scale via increased LNG train capacity size and improvement in LNG berth utilization.

There remains a need to explore alternative designs for LNG storage and offloading facilities.

SUMMARY

According to a first aspect of the present invention there is provided an LNG production plant positioned at a production location adjacent to a body of water, the LNG production plant comprising a plurality of spaced-apart facilities including a first facility and a second facility, each facility provided with plant equipment related to a predetermined function associated with the production of LNG, wherein the first facility is an onshore facility and the second facility is an integrated storage/offloading facility arranged on a gravity-based structure having a base that rests on the seabed at a selected location within the body of water, wherein the first facility is a liquefaction facility for receiving a stream of pre-treated gas from a gas processing facility and liquefying the pre-treated gas to produce a product stream of LNG, and, the integrated storage/offloading facility includes a first cryogenic storage tank operatively associated with the liquefaction facility for receiving and storing the product stream of LNG from the liquefaction facility via a cryogenic pipeline, and, an LNG transfer facility for transferring LNG from the first cryogenic storage tank to a second cryogenic storage tank onboard an LNG Carrier on an as-needs basis.

In one form, the selected location has a water depth of at least 14 meters, at least 15 meters, or at least 16 meters. In one form, the integrated storage/offloading facility is a breakwater for an LNG Carrier. In one form, the cryogenic pipeline is a cryogenic subsea pipeline or a cryogenic pipeline on a trestle.

In one form, the first facility is a gas processing facility for receiving raw hydrocarbons from a producing well and treating the raw hydrocarbons to remove contaminants therefrom to produce a stream of treated gas as a source of feed to a liquefaction facility for receiving the stream of treated gas from a gas processing module and liquefying the natural gas to produce LNG, and wherein the liquefaction facility is located on the gravity-based structure with the integrated storage/offloading facility.

In one form, the integrated storage/offloading facility is transportable from a construction location to an assembly location by towing or on floating barges. In one form, the integrated storage/offloading facility is transportable from an assembly location to the production location by towing or on floating barges. In one form, commissioning of the integrated storage/offloading facility is done at an onshore construction location or an onshore assembly location prior to transportation of integrated storage/offloading facility to the production location. In one form, the integrated storage/offloading facility includes a ballast storage compartment, and the integrated storage/offloading facility is settled into the selected location by way of addition of a ballasting material to the ballast storage compartment. In one form, the ballast storage compartment is arranged around the periphery of the integrated storage/offloading facility or arranged toward the base of the integrated storage/offloading facility for ballasting. In one form, the ballast storage compartment is at least partially filled with one or both of a solid ballasting material or a liquid ballasting material. In one form, the solid ballasting material is iron ore or sand. In one form, the liquid ballasting material is one or more of: water, condensate, monoethylene glycol (MEG), methanol, diesel, demineralised water, diesel, or, LPG.

In one form, integrated storage/offloading facility includes a boil-off gas reliquefaction facility. In one form, the integrated storage/offloading facility has at least one lateral side which has a length of a sufficient size to allow an LNG Carrier to be moored along alongside the gravity-based structure without overhang of the LNG Carrier beyond an end of the gravity-based structure. In one form, the integrated storage/offloading facility has a lee side, whereby, in use, the LNG Carrier approaches the integrated storage/offloading facility from the lee side of integrated storage/offloading facility. In one form, the integrated storage/offloading facility has a longitudinal axis aligned substantially parallel to the direction of a predominant current for bi-directional berthing of an LNG Carrier.

In one form, the integrated storage/offloading facility comprises a plurality of similarly-sized sub-facilities, which are integrated at a construction location, the production location, or at an independent assembly location. In one form, the sub-facilities are constructed at a plurality of construction locations and towed to a common assembly location for integration. In one form, the sub-facilities are assembled to form the integrated storage/offloading facility at the assembly location and testing or commissioning of the sub-facilities is conducted a construction or assembly location before transportation of the integrated storage/offloading facility to the production location.

In one form, the integrated storage/offloading facility is movable from a first production location to a second production location. In one form, the integrated storage/offloading facility includes a boil-off gas reliquefaction facility for liquefying at least a portion of the boil off gas that is generated either during the transfer of the LNG through the pipeline to the first cryogenic storage tank of the integrated storage/offloading facility or during the transfer of the LNG from the first cryogenic storage tank to the second cryogenic storage tank of the LNG Carrier. In one form, a portion of boil off gas is a source of fuel for a first power generation system which forms part of the integrated storage/offloading facility or a second power generation facility onboard the LNG Carrier. In one form, a first portion of the LNG produced by the liquefaction facility is transferred directly into a second cryogenic storage tank onboard an LNG Carrier and a second portion of the LNG produced by the liquefaction facility is stored in the first cryogenic storage tank of the integrated storage/offloading facility. In one form, the integrated storage/offloading facility has a multilateral footprint when viewed in plan view. In one form, the footprint is triangular, rectangular, square, pentagonal or hexagonal whereby, in use, a first LNG Carrier berths at a first lateral side of the integrated storage/offloading facility while a second LNG Carrier berths at a second lateral side of the integrated storage/offloading facility.

In one form, the LNG production plant further comprises a breakwater facility positioned adjacent to the integrated storage/offloading facility at the selected location. In one form, a first breakwater facility is located towards a first end of the integrated storage/offloading facility and a second breakwater facility is located towards a second end of the integrated storage/offloading facility.

BRIEF DESCRIPTION OF THE DRAWINGS

In order to facilitate a more detailed understanding of the nature of the invention several embodiments of the present invention will now be described in detail, by way of example only, with reference to the accompanying drawings, in which.

Figure 1:
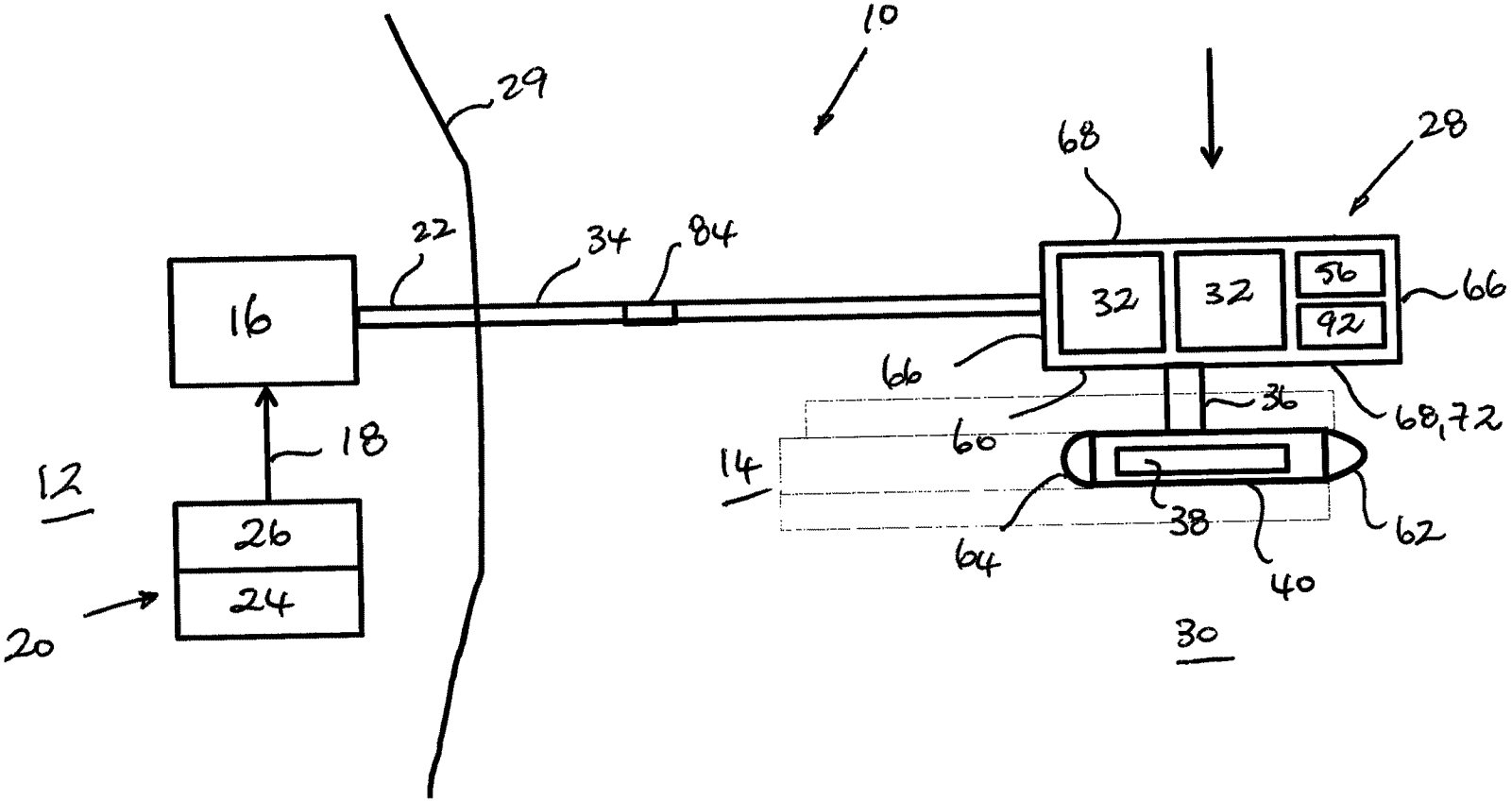
FIG. 1 is a schematic plan view of a first embodiment of the present invention.

It is to be noted that the drawings illustrate only preferred embodiments of the invention and are therefore not to be considered limiting of the invention's scope as it may admit to other equally effective embodiments. Like reference numerals refer to like parts. The components in the figures are not necessarily to scale, emphasis instead being placed upon illustrating the principles of the invention. Moreover, all drawings are intended to convey concepts, where relative sizes, shapes and other detailed attributes may be illustrated schematically rather than literally or precisely.

DETAILED DESCRIPTION

Particular embodiments of the present invention are now described. The terminology used herein is for the purpose of describing particular embodiments only, and is not intended to limit the scope of the present invention. Unless defined otherwise, all technical and scientific terms used herein have the same meanings as commonly understood by one of ordinary skill in the art to which this invention belongs.

Throughout this specification, the term "integrated storage/offloading facility" refers to a storage facility that is located together with an offloading facility, for example on top of or inside of a gravity based structure.

Using the process and system of the present invention, an LNG production plant is positioned at a production location adjacent to a body of water, the LNG production plant comprising a plurality of spaced-apart facilities including a first facility and a second facility, each facility provided with plant equipment related to a pre-determined function associated with the production of LNG, wherein the first facility is an onshore facility and the second facility is arranged on a gravity-based structure having a base that rests on the seabed at a selected location within the body of water. More specifically, embodiments of the present invention relate to an LNG production plant including at least the following facilities:

a) a gas processing facility for receiving raw hydrocarbons from a producing well and treating the raw hydrocarbons to remove contaminants therefrom to produce a stream of treated gas;
b) a liquefaction facility for receiving the stream of treated gas from a gas processing facility and liquefying the natural gas to produce a product stream of LNG;
c) a storage facility operatively associated with a transfer means for receiving the product stream of LNG from the liquefaction facility for receiving and storing LNG in a first cryogenic storage tank; and,
d) an offloading facility including LNG transfer facilities to transfer the LNG from the first cryogenic storage tank of the storage facility to a second cryogenic storage tank onboard an LNG Carrier on an as-needs basis.

A first embodiment is now described with reference to FIGS. 1 to 3 in which an LNG production plant 10 is positioned at a production location 12 adjacent to a body of water 14. The production plant includes a first facility in the form of an onshore liquefaction facility 16 for receiving a stream of pre-treated gas 18 from a gas processing facility 20 and liquefying the pre-treated gas stream to produce a product stream of LNG 22. The gas processing facility includes an acid gas removal facility 24 and a dehydration and mercury removal facility 26 of the kind that is known in the art. Liquefaction is achieved onshore each liquefaction facility using any liquefaction process well established in the art which typically involve compression, expansion and cooling. Such prior art liquefaction processes include processes based on a nitrogen cycle, the APCI C3/MR™ or Split MR™ or AP-X™ processes, the Phillips Optimized Cascade Process, the Linde Mixed Fluid Cascade process or the Shell Double Mixed Refrigerant or Parallel Mixed Refrigerant process.

In the embodiment illustrated in FIG. 1, the storage facility and the offloading facility have been combined to provide a second facility in the form of an integrated storage/offloading facility 28 arranged at a selected location 30 in the body of water 14. The integrated storage/offloading facility 28 has a first cryogenic storage tank 32 operatively associated with the liquefaction facility 16 for receiving LNG from the onshore liquefaction facility via a cryogenic pipeline 34 and storing LNG in the first cryogenic storage tank. The first storage tank 32 may be one of a plurality of first storage tanks with two such first storage tanks illustrated in FIG. 1 by way of example only. The integrated storage/offloading 28 further includes an LNG transfer facility 36 for transferring LNG from the first cryogenic storage tank 32 to a second cryogenic storage 38 tank onboard an LNG Carrier 40. The first cryogenic storage tank may be a double containment, full containment, prismatic or membrane systems with a primary tank constructed from, by way of example, stainless steel, aluminum, and/or 9%-nickel steel. The first cryogenic storage tank may include pretensioned concrete to provide structural resistance to the stored LNG, boil off gas pressure loads and to external hazards.

Figure 2:
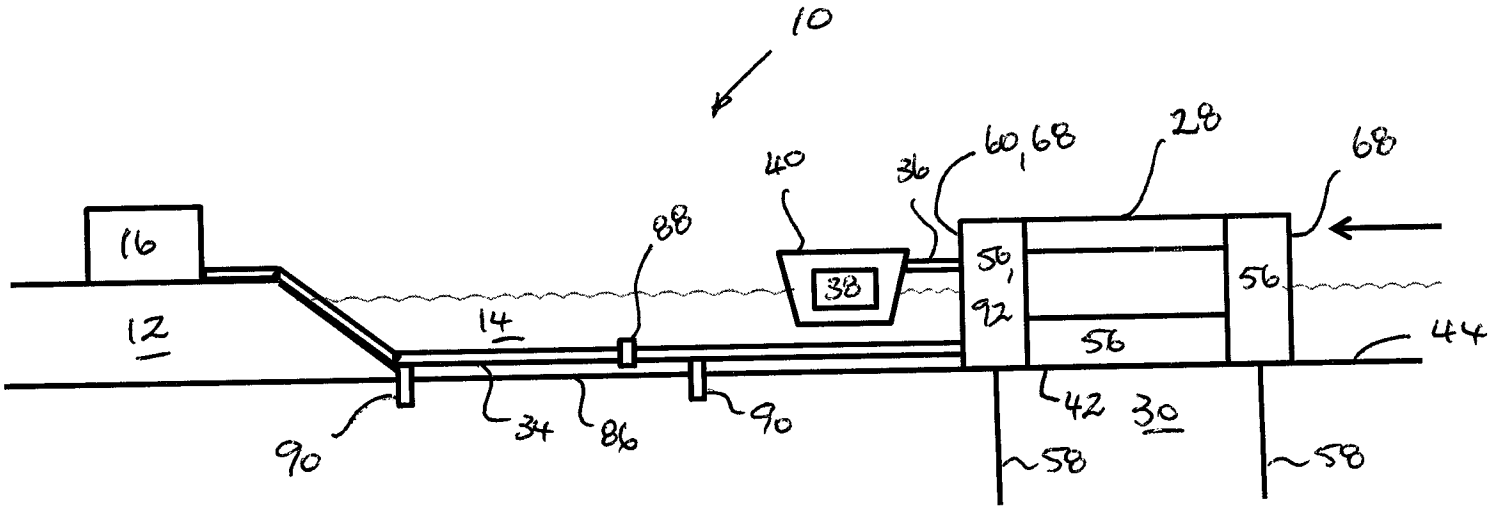
FIG. 2 is a schematic side view of the first embodiment of the present invention.

In the embodiment illustrated in FIG. 2, the integrated storage/offloading facility 28 is a gravity based structure with a base 42 of the integrated storage/offloading facility 28 resting on the seabed 44 at the selected location 30 within the body of water 14 to maximise the stability of the integrated storage/offloading 28. By way of example, the gravity based structure is constructed using lightweight or semi-lightweight concrete (having a density of less than about 2000 kg/m$^3$). Alternatively or additionally, the gravity based structure may be constructed of steel or a hybrid comprising a combination of steel and concrete or a composite material. Advantageously, the integrated storage/offloading facility is able to be constructed and commissioned at a construction location such as a shipyard or another location where trained and efficient labour force is available and floated in before being positioned at the selected location 30 to act as a breakwater for the LNG Carrier to reduce environmental loads (illustrated by way of an arrow in FIG. 2) on the LNG Carrier 40.

Figure 3:
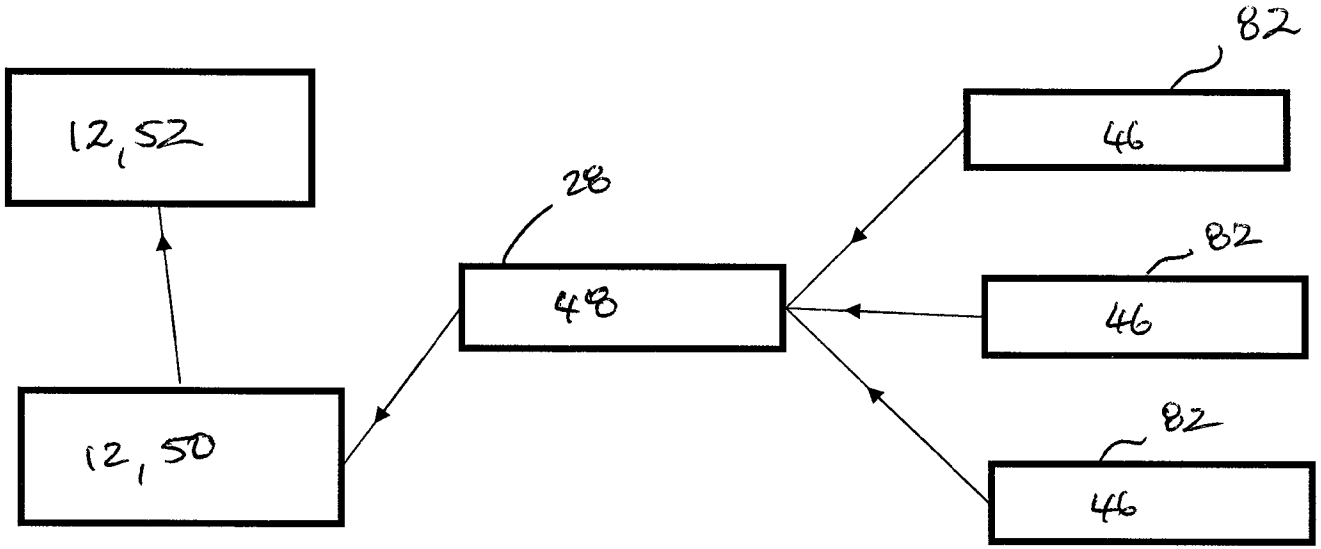
FIG. 3 is a process diagram illustrating the use of a plurality of independent construction locations, an assembly location and relocatability of the LNG production facility from a first location to a second location.

Referring to FIG. 3, the integrated storage/offloading 28 is transportable from a construction location 46 to the production location 12 or from the assembly location 48 to the production location 12 by towing or on floating barges. The construction location may be one of a plurality of constructions locations with three shown in FIG. 3 by way of example only. Advantageously, testing or pre-commissioning of the integrated storage/offloading 28 can be conducted before transportation of the integrated storage/offloading 28 to the production location 14. This feature not only allows the facility to be deployed where required but is also advantageous when maintenance or upgrading is required. The integrated storage/offloading facility may be re-deployed at a different location at a later time to suit LNG supply and demand, for example, due to changes in the capacity of the production plant or towards the end of a gas field life. Thus with reference to FIG. 3, the integrated storage/offloading facility can be moved from a first production location 50 to a second production location 52.

To allow sufficient water depth for an LNG Carrier 40 to berth alongside the integrated storage/offloading facility 28, the selected location 30 has a water depth as measured from the waterline 54 to the seabed 44 of at least 14 meters, at least 15 meters, or at least 16 meters. The integrated storage/offloading facility 28 includes a ballast storage compartment 56, preferably arranged around the periphery of the integrated storage/offloading facility or arranged toward the base of the facility, for ballasting. For flexibility to adjust the level of ballasting to suit the seabed conditions at a given selected location 30, the ballast storage compartment may be one of a plurality of ballast storage compartments with three ballast storage compartments shown in FIG. 2 by way of example only. The integrated storage/offloading facility 28 is towed from the construction or assembly location (46 or 48, respectively) to the production location 12 and then arranged at the selected location 30 where settling is achieved by the addition of a ballasting material to the ballast storage compartment 56 until the base 42 of the integrated storage/offloading facility 28 rests on the seabed 44 to secure the position of the integrated storage/offloading facility 28. This provides the integrated storage/offloading facility with greater stability. The amount of ballasting material required to secure the integrated storage/offloading facility to the seabed at the selected location depends on a number of relevant factors including but not limited to the shear strength of the underlying clay or silt material found at the bottom of the body of water at the selected location. If required, the the integrated storage/offloading facility 28 may include a piling system 58 to anchor the integrated storage/offloading facility 28 into the seabed 44. The ballasting material may be a solid ballasting material or a liquid ballasting material. By way of example, one or both of iron ore and sand may be used as the solid ballast material. In one embodiment of the present invention, the liquid ballasting material is water, condensate, monoethylene glycol (MEG), methanol, diesel, demineralised water, LPG or combinations thereof. The liquid ballasting material may be stored in a non-cryogenic storage tank.

In use, an LNG Carrier 40 comes in to berth at the integrated storage/offloading facility 28 to receive a cargo of LNG. The integrated storage/offloading facility 28 is designed so that the LNG Carrier 40 may approach the integrated storage/offloading facility from either direction depending on the prevailing weather conditions. A side of the integrated storage/offloading facility that is facing away from the prevailing weather conditions is referred to as the "lee side". Preferably, the integrated storage/offloading facility 28 has a lee side 60, whereby, in use, the LNG Carrier 40 approaches the integrated storage/offloading facility 28 from the lee side 60 of the integrated storage/offloading facility 28. Depending on the size of the LNG Carrier, the bow 62 or the stern 64 of the LNG Carrier 40 may extend beyond an end 66 of the integrated storage/offloading facility 28 when the LNG Carrier 40 is berthed alongside the integrated storage/offloading facility 28. This overhang of the bow or stern of the LNG Carrier beyond an end of the integrated storage/offloading facility may expose the LNG Carrier to adverse environmental conditions. To minimize this effect, the integrated storage/offloading facility 28 preferably has at least one lateral side 68 which has a length of a sufficient size to allow an LNG carrier to be moored along alongside the integrated storage/offloading facility 28 without overhang of the LNG Carrier 40 beyond an end of the integrated storage/offloading facility. The integrated storage/offloading facility 28 can be fitted with fendering equipment (not shown) to absorb a substantial portion of a load generated by impact of the LNG Carrier with the integrated storage/offloading facility during transfer of LNG from the first cryogenic tank 32 to the second cryogenic tank 38.

The integrated storage/offloading facility 28 may comprise a plurality of similarly-sized sub-modules 82, which can be integrated at the production location 12, at a construction location 46, or at an independent assembly location 48. The sub-modules may be constructed at separate construction locations and towed to a common assembly location. This option is particularly attractive if there is a restriction on the space available at the dry dock or "graving dock" or restrictions on the towable or installable size of a given facility or sub-facility. Advantageously, once the sub-modules have been assembled to form the integrated storage/offloading facility at the assembly location, testing or pre-commissioning of the integrated storage/offloading facility can be conducted before transportation of the integrated storage/offloading facility to the production location. It is particularly advantageous when such pre-commissioning can be done at an assembly location onshore prior to transportation of the facility to a production location offshore or near shore.

As set out above, the first cryogenic storage tank 32 which forms a part of the integrated storage/offloading facility 28 is operatively associated with the liquefaction facility 16 and receives a product stream of LNG 22 from the liquefaction facility 16 via a cryogenic pipeline 34. In the embodiment illustrated in FIG. 2, the cryogenic pipeline is a subsea cryogenic pipeline which is a preferred option when the selected location 30 is located more than 500 meters from the shoreline 29. However, a cryogenic pipeline arranged on a trestle may be used as an alternative, particularly when the selected location 30 is less than 500 meters from the shoreline 29. When the cryogenic pipeline is a subsea cryogenic pipeline, it may take the form of a dual-wall pipe-in-pipe or triple-wall pipe-in-pipe-in-pipe system. Using a dual-wall pipe-in-pipe system, the cryogenic subsea pipeline includes an inner pipe for carrying LNG and an outer jacket around the inner pipe defining an annular space there between with a layer of insulation in the annular space. Using a triple-wall pipe-in-pipe-in-pipe system, an intermediate pipe is located between an inner pipe and an outer pipe to protect the inner pipe from damage and to insulate the inner pipe to reduce heat leak and minimise LNG vaporization. Using either system, the inner pipe is preferably constructed from a pipeline material having sufficient ductility and toughness to be usable at cryogenic temperatures, for example, aluminium, high nickel content steels or austenitic stainless steels. One example of a suitable pipeline material is 36% nickel steel (known in the art commercially as INVAR) which allows the cryogenic subsea pipelie it to be restrained at both ends and used for LNG service without the use of an expansion joint. Alternatively, the cryogenic subsea pipeline may include at least one expansion joint 84 to compensate for thermal expansion and contraction. One example of an expansion joint is a bellows type expansion joint in which contraction is taken up by a longitudinal bellows or corrugations in the inner pipe. The bellows is constructed out of a material that is relatively thinner than the material of the LNG pipeline so the bellows is free to expand and contract axially with respect to the LNG pipeline.

In the embodiment illustrated in FIG. 2, the cryogenic subsea pipeline 34 includes an elongate open frame 86 adapted to be laid underwater is used for supporting the pipeline and resisting subsea forces on the pipeline. At least one pipe anchor 88 is attached to the pipeline 34 and to the frame 86 to transfer axial forces in pipeline 34 to the frame 86. At least one steel or concrete ground anchor 90 is attached to the frame 86 for transmitting axial forces in the frame 86 to the sea bed 44.

The LNG transfer facility 36 located on the integrated storage/offloading facility 28 includes a fixed or swivel joint loading arm above the water surface, preferably fitted with an emergency release system at one end of the loading arm. Between transfer operations, the LNG transfer facility may be kept cold by re-circulation of a small quantity of LNG. The LNG transfer facility may include an emergency safety system to allow loading to be stopped if required in a quick, safe, and controlled manner by closing an isolation valve on the LNG transfer lines or shutting down the cargo pumps associated with the cryogenic storage tank 38 onboard the LNG carrier 40. The emergency safety system is designed to allow LNG transfer to be restarted with minimum delay after corrective action has been taken.

In a preferred embodiment, the integrated storage/offloading facility 28 includes a boil-off gas reliquefaction facility 92 for liquefying at least a portion of the boil off gas that is generated either during the transfer of the LNG through the cryogenic subsea pipeline to the first cryogenic storage tank 32 of the integrated storage/offloading facility 28 or during the transfer of the LNG from the first cryogenic storage tank 32 to the second cryogenic storage tank 38 of the LNG Carrier. The reliquefied boil-off gas may be returned for storage in the first cryogenic storage tank. Boil off gas is generated due to one or more of the following: a) cooling down of the interior surfaces of the second cryogenic storage tank onboard the LNG Carrier; b) heat leaking in from the environment through the exterior surfaces of the second cryogenic storage tank onboard the LNG Carrier; c) heat from the cryogenic pumps used to transfer the LNG from the first cryogenic storage tank to the second cryogenic storage tank; and d) heat ingress from the LNG transfer facility transfer hoses or loading arms; e) flashing off due to a temperature increase during the transfer operation, and, f) flashing due to pressure drop during LNG transfer from liquefaction to storage. The inclusion of a boil-off gas reliquefaction facility as an integral part of the integrated storage/offloading facility overcomes the need for the cryogenic subsea pipeline to include a vapour return line. Alternatively or additionally, a portion of the boil off gas may be used as a source of fuel for a first power generation system which forms part of the integrated storage/offloading facility or a second power generation facility onboard the LNG Carrier. In addition to this, the first cryogenic storage tank of the integrated storage/offloading facility can be operated at a higher pressure compared with the second cryogenic storage tank of the LNG carrier by way of using reinforced membrane tank technology to minimize boil-off gas generation. Alternatively, the boil-off gas may be compressed and transferred via a subsea pipeline to an onshore gas processing plant or recycled back to the integrated storage/offloading facility 28.

Figure 4:
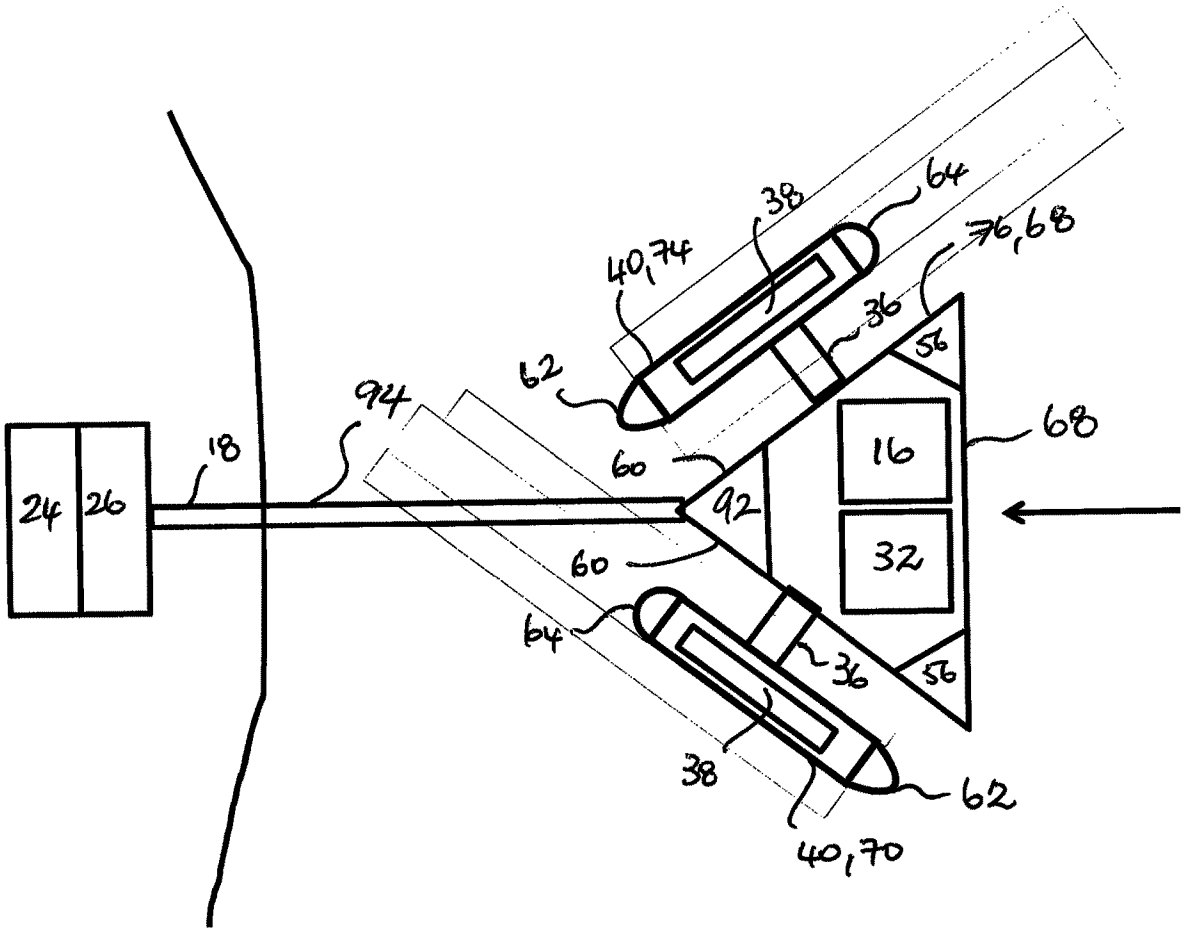
FIG. 4 is a schematic plan view of a second embodiment of the present invention.
Figure 5:
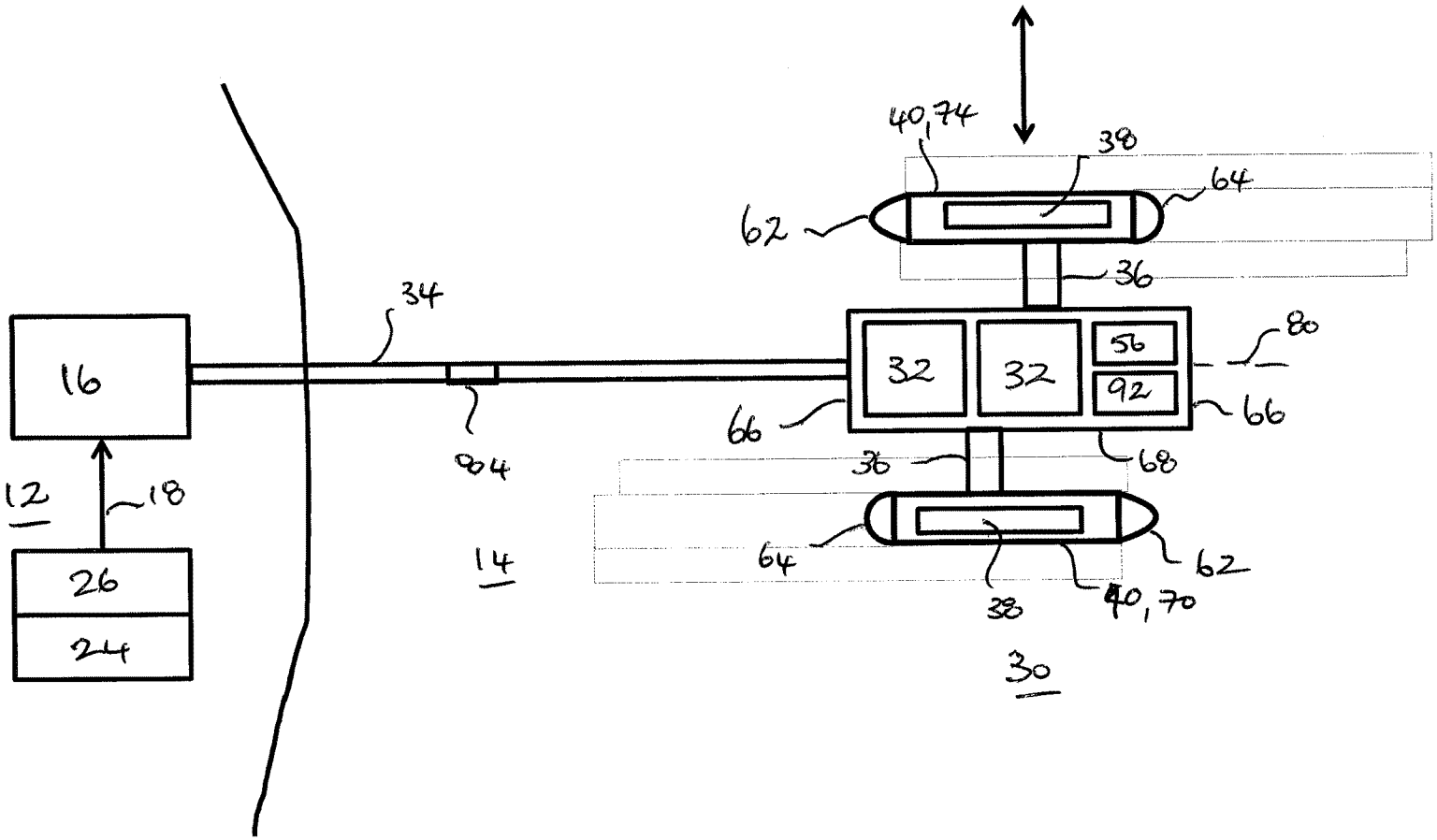
FIG. 5 is a schematic plan view of an embodiment of the present invention.

A second embodiment of the present invention is now described with reference to FIG. 4 which allows continuous or semi-continuous loading of LNG without the need to use a cryogenic pipeline 34. In this embodiment, the LNG production plant 10, positioned at a production location 12 adjacent to a body of water 14, includes an onshore gas processing plant 20 with the liquefaction facility being integrated into the integrated storage/offloading facility 28 arranged at a selected location 30 in the body of water 14. In this embodiment, a gas pipeline 94 replaces the cryogenic pipeline 34, the gas pipeline being cheaper to construct, lay, and maintain. Advantageously, a portion of the LNG produced by the liquefaction facility 16 can be transferred directly into the second cryogenic storage 38 tank onboard an LNG Carrier 40, whenever an LNG Carrier is berthing at the offloading facility 28, reducing the need to store the LNG in the first cryogenic storage tank 32 of the offloading facility 28. In the embodiment illustrated in FIG. 4, the integrated storage/offloading facility 28 has a multilateral footprint when viewed in plan view. This footprint provides for continuous or semicontinuous production whereby a first LNG Carrier 70 berths at a first lateral side 72 of the integrated storage/offloading facility 28 while a second LNG Carrier 74 berths at a second lateral side 76 of the integrated storage/offloading facility 28. In the embodiment shown in FIG. 4, the integrated storage/offloading facility 28 has a triangular footprint with the first and second lateral sides (72 and 76, respectively) each representing a lee side 60 based on the prevailing weather conditions indicated by the arrow in FIG. 4. However, the multilateral footprint could equally be rectangular, square, pentagonal or hexagonal. In the embodiment illustrated in FIG. 5, the footprint of the integrated storage/offloading facility 28 is rectangular such that the integrated storage/offloading facility 28 has a longitudinal axis 80 aligned substantially parallel to the direction of a predominant current for bi-directional berthing of an LNG Carrier 40. Preferably each of the first and second lateral sides (72 and 76, respectively) has a length of a sufficient size to allow an LNG carrier to be moored along alongside the integrated storage/offloading facility 28 without overhang of the LNG Carrier 40 beyond an end of the integrated storage/offloading facility.

Figure 6:
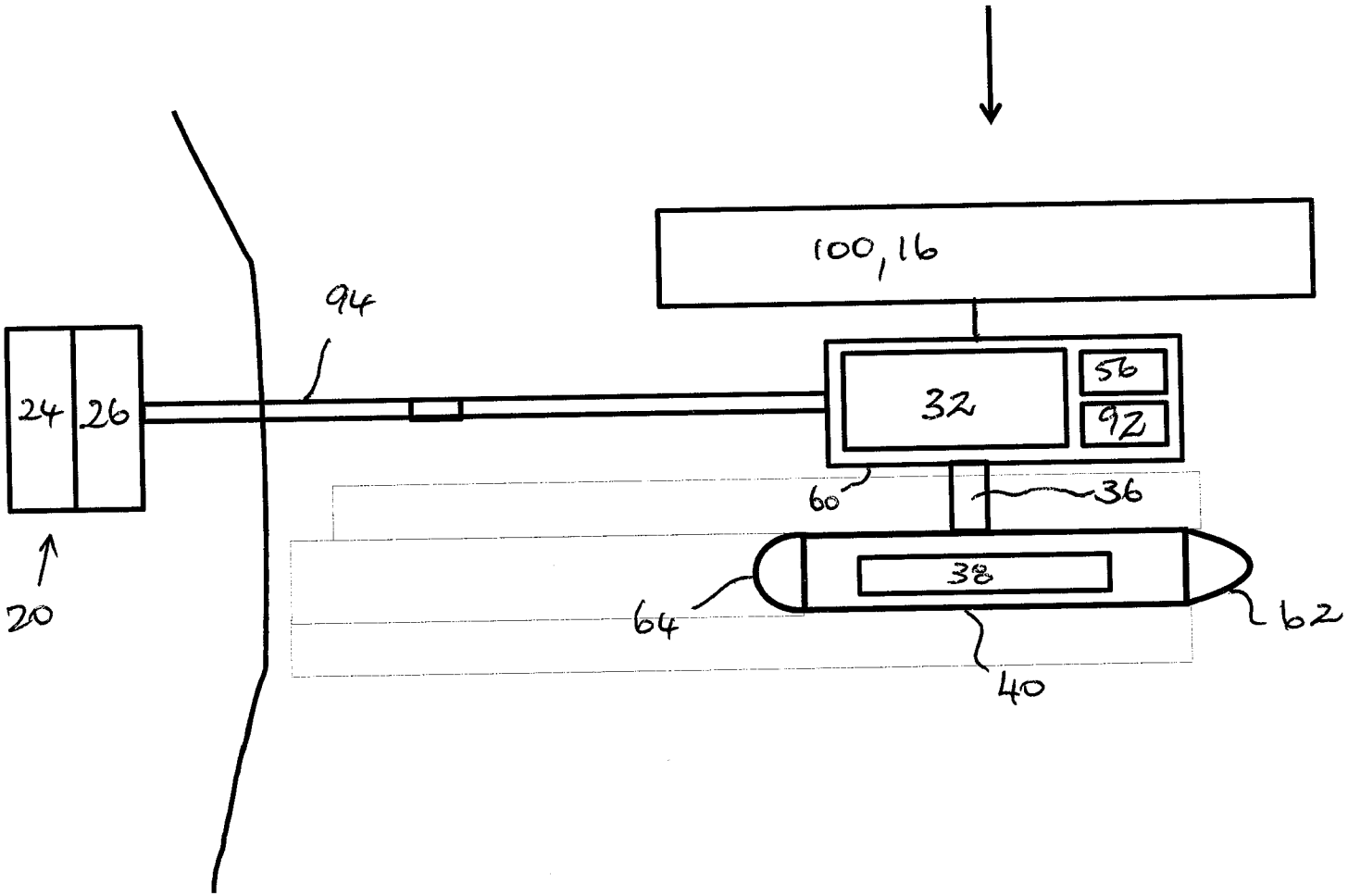
FIG. 6 is a schematic plan view of an embodiment of the present invention showing the use of a breakwater facility; and, FIG. 7 is a schematic plan view of an embodiment of the present invention showing the use of a first breakwater facility and a second breakwater facility.
Figure 7:
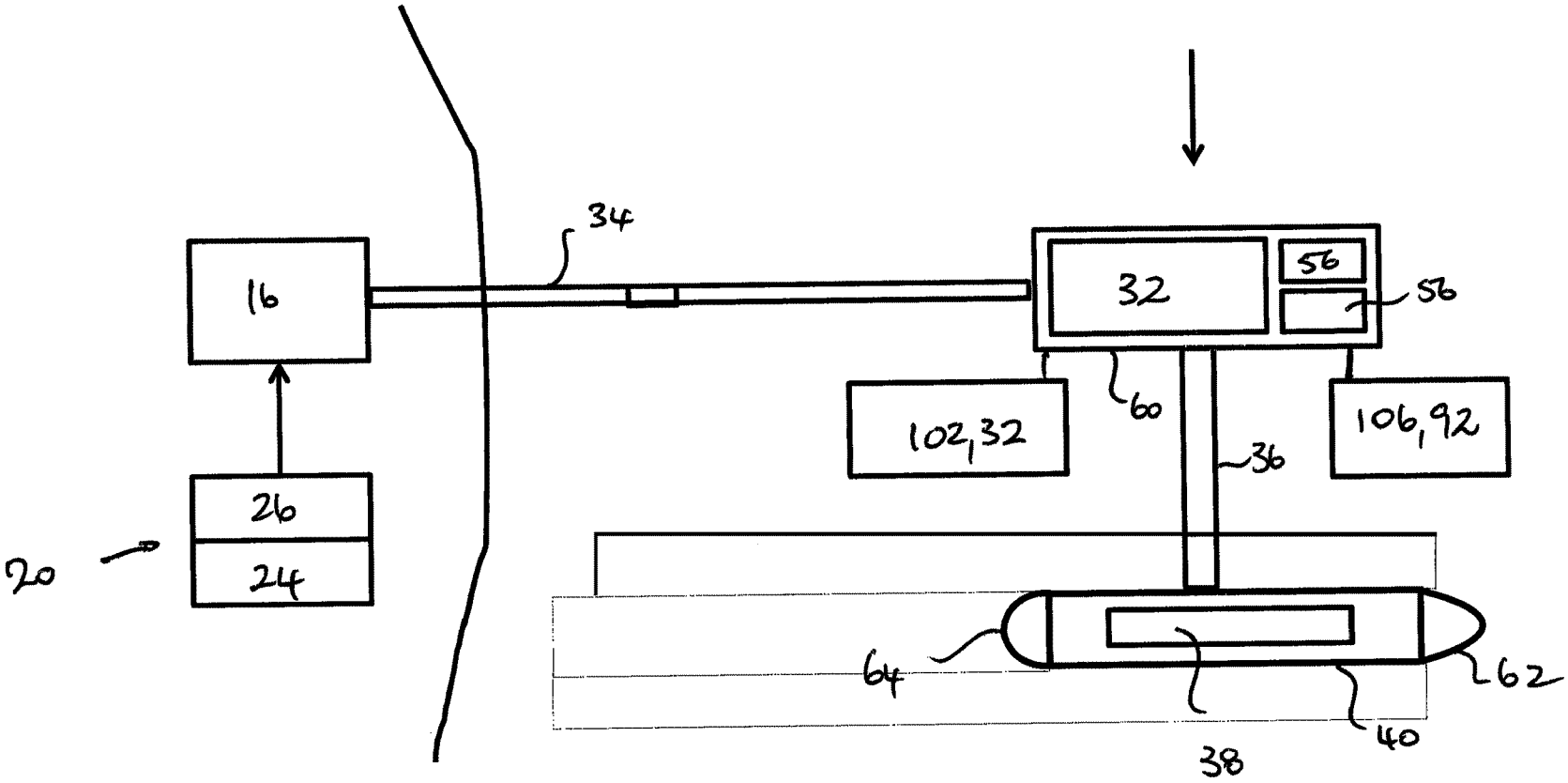

A third embodiment is now described with reference to FIG. 6 and FIG. 7 which illustrate continuous production. In the embodiment illustrated in FIG. 6, the lee side 60 has a length that is less than the length of the LNG Carrier 40. When the LNG carrier 40 is moored along alongside the integrated storage/offloading facility 28, one or both of the stern 62 or the bow 64 of the LNG Carrier 40 extends beyond the length of the lee side 60 of the integrated storage/offloading facility 28. In order to provide breakwater protection for the LNG Carrier 40, a breakwater facility 100 is floated in and positioned adjacent to the integrated storage/offloading facility 28 at the selected location 30. In FIG. 6, the breakwater facility 100 is arranged to provide a breakwater to the integrated storage/offloading facility 28 and the LNG Carrier 40 with only one breakwater facility 100 being shown. In embodiment illustrated in FIG. 7, two such breakwater facilities are shown. In FIG. 6, the liquefaction facility 16 is the breakwater facility 100. In FIG. 7, the liquefaction facility 16 is onshore. A first breakwater facility 102 is located towards a first end 104 of the integrated storage/offloading facility 28 with a second breakwater facility 106 being located towards a second end 108 of the integrated storage/offloading facility 28. In this embodiment, the first cryogenic storage tank 32 operatively associated with the liquefaction facility 16 is integrated with the breakwater facility 100 with the boil-off gas reliquefaction facility 92 being integrated with the second breakwater facility.

Now that several embodiments of the invention have been described in detail, it will be apparent to persons skilled in the relevant art that numerous variations and modifications can be made without departing from the basic inventive concepts. For example, an LNG Carrier may be used as the offloading facility. By way of further example, the liquefaction facility may be integrated with the offloading facility. All such modifications and variations are considered to be within the scope of the present invention, the nature of which is to be determined from the foregoing description and the appended claims.

It will be clearly understood that, although a number of prior art publications are referred to herein, this reference does not constitute an admission that any of these documents forms part of the common general knowledge in the art, in Australia or in any other country. In the summary of the invention, the description and claims which follow, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. An LNG production plant positioned at a production location adjacent to a body of water, the LNG production plant comprising:

a plurality of spaced-apart facilities including a first facility and a second facility, each facility provided with plant equipment related to a pre-determined function associated with the production of LNG, wherein the first facility is an onshore facility and the second facility is an integrated storage/offloading facility arranged on a gravity-based structure having a base that rests on the seabed at a selected location within the body of water; and a cryogenic pipeline from the onshore facility to the integrated storage/offloading facility;

wherein:

the first facility is a liquefaction facility for receiving a stream of pre-treated gas from a gas processing facility and liquefying the pre-treated gas to produce a product stream of LNG;

the integrated storage/offloading facility includes: a first cryogenic storage tank operatively associated with the liquefaction facility for receiving and storing the product stream of LNG from the liquefaction facility via the cryogenic pipeline, a boil-off gas re-liquefaction facility, and an LNG transfer facility for transferring LNG from the first cryogenic storage tank to a second cryogenic storage tank onboard an LNG Carrier on an as-needs basis;

a subsea pipeline is provided from the integrated storage/offloading facility to the onshore gas processing plant;

boil-off gas is generated during the transfer of the LNG through the cryogenic pipeline to the first cryogenic storage tank of the integrated storage/offloading facility; and the boil-off gas is: compressed and transferred through the subsea pipeline to the onshore facility, or recycled back to the integrated storage/offloading facility, or liquefied at the re-liquefaction facility at the offshore location.

2. The LNG production plant of claim 1, wherein the first cryogenic storage tank of the integrated storage/offloading facility stores the LNG at a higher pressure compared with the second cryogenic storage tank of the LNG carrier.

3. The LNG production plant of claim 1, wherein the integrated storage/offloading facility is a breakwater for the LNG Carrier.

4. The LNG production plant of claim 1, wherein the cryogenic pipeline is a cryogenic subsea pipeline or a cryogenic pipeline on a trestle and connects to the gravity-based structure at a subsea location.

5. The LNG production plant of claim 1, wherein the first facility is a gas processing facility for receiving raw hydrocarbons from a producing well and treating the raw hydrocarbons to remove contaminants therefrom to produce a stream of treated gas as a source of feed to the liquefaction facility for receiving the stream of treated gas from a gas processing module and liquefying the natural gas to produce LNG, and wherein the LNG transfer facility is located on the gravity-based structure with the integrated storage/offloading facility.

6. The LNG production plant of claim 1, wherein the integrated storage/offloading facility is transportable from a construction location to an assembly location by towing or on floating barges.

7. The LNG production plant of claim 1, wherein the integrated storage/offloading facility is transportable from an assembly location to the production location by towing or on floating barges.

8. The LNG production plant of claim 1, wherein commissioning of the integrated storage/offloading facility is done at an onshore construction location or an onshore assembly location prior to transportation of integrated storage/offloading facility to the production location.

9. The LNG production plant of claim 1, wherein the integrated storage/offloading facility includes a ballast storage compartment, and the integrated storage/offloading facility is settled into the selected location by way of addition of a ballasting material to the ballast storage compartment.

10. The LNG production plant of claim 9, wherein the ballast storage compartment is arranged around the periphery of the integrated storage/offloading facility or arranged toward the base of the integrated storage/offloading facility for ballasting.

11. The LNG production plant of claim 9, wherein the ballast storage compartment is at least partially filled with one or both of a solid ballasting material or a liquid ballasting material.

12. The LNG production plant of claim 11, wherein the solid ballasting material is iron ore or sand.

13. The LNG production plant of claim 11, wherein the liquid ballasting material is one or more of: water, condensate, monoethylene glycol (MEG), methanol, diesel, demineralised water, diesel, or, LPG.

14. The LNG production plant of claim 1, wherein the integrated storage/offloading facility includes a boil-off gas reliquefaction facility.

15. The LNG production plant of claim 1, wherein the integrated storage/offloading facility has at least one lateral side which has a length of a sufficient size to allow an LNG Carrier to be moored along alongside the gravity-based structure without overhang of the LNG Carrier beyond an end of the gravity-based structure.

16. The LNG production plant of claim 1, wherein the integrated storage/offloading facility has a lee side, whereby, in use, the LNG Carrier approaches the integrated storage/offloading facility from the lee side of integrated storage/offloading facility.

17. The LNG production plant of claim 1, wherein the integrated storage/offloading facility has a longitudinal axis aligned substantially parallel to the direction of a predominant current for bi-directional berthing of an LNG Carrier.

18. The LNG production plant of claim 1, wherein the integrated storage/offloading facility comprises a plurality of similarly-sized sub-facilities, which are integrated at a construction location, the production location, or at an independent assembly location.

19. The LNG production plant of claim 18, wherein the sub-facilities are constructed at a plurality of construction locations and towed to a common assembly location for integration.

20. The LNG production plant of claim 18, wherein the sub-facilities are assembled to form the integrated storage/offloading facility at the assembly location and testing or commissioning of the sub-facilities is conducted a construction or assembly location before transportation of the integrated storage/offloading facility to the production location.

21. The LNG production plant of claim 1, wherein the integrated storage/offloading facility is movable from a first production location to a second production location.

22. The LNG production plant of claim 1, wherein a portion of boil off gas is a source of fuel for a first power generation system which forms part of the integrated storage/offloading facility or a second power generation facility onboard the LNG Carrier.

23. The LNG production plant of claim 1, wherein a first portion of the LNG produced by the liquefaction facility is transferred directly into a second cryogenic storage tank onboard an LNG Carrier and a second portion of the LNG produced by the liquefaction facility is stored in the first cryogenic storage tank of the integrated storage/offloading facility.

24. The LNG production plant of claim 1, wherein the integrated storage/offloading facility has a multilateral footprint in plan view.

25. The LNG production plant of claim 24, wherein the footprint is triangular, rectangular, square, pentagonal or hexagonal such that, in use, a first LNG Carrier berths at a first lateral side of the integrated storage/offloading facility while a second LNG Carrier berths at a second lateral side of the integrated storage/offloading facility.

26. The LNG production plant of any claim 1, further comprising a breakwater facility positioned adjacent to the integrated storage/offloading facility at the selected location.

27. The LNG production plant of claim 1, wherein a first breakwater facility is located towards a first end of the integrated storage/offloading facility and a second breakwater facility is located towards a second end of the integrated storage/offloading facility.

* * * * *